US006160096A

United States Patent [19]

Sakashita et al.

[11] Patent Number: 6,160,096

[45] Date of Patent: Dec. 12, 2000

[54] REGENERATED COLLAGEN FIBER AND METHOD OF MANUFACTURING THE SAME

[75] Inventors: Shinichi Sakashita; Mamoru Tsugawa; Masaoki Goto; Kunihiko Matsumura; Norio Hirokawa, all of Kobe, Japan

[73] Assignee: Kaneka Corporation, Osaka, Japan

[21] Appl. No.: 09/113,423

[22] Filed: Jul. 10, 1998

[30] Foreign Application Priority Data

| | | | |
|---|---|---|---|
| Jul. 11, 1997 | [JP] | Japan | 9-186794 |
| Mar. 12, 1998 | [JP] | Japan | 10-061378 |
| Apr. 27, 1998 | [JP] | Japan | 10-116819 |

[51] Int. Cl.[7] ..... A61K 38/17; A61K 7/06; A61K 7/09

[52] U.S. Cl. ..... 530/356; 530/402; 514/21; 514/801; 424/70.1; 424/70.2; 424/70.4; 424/70.51

[58] Field of Search ..... 530/356, 402; 514/21, 801; 424/70.51, 401, 70.1, 70.2, 70.4, 70.5

[56] References Cited

U.S. PATENT DOCUMENTS

| | | | |
|---|---|---|---|
| 4,767,827 | 8/1988 | Iwatsuki et al. | 525/420 |
| 5,055,561 | 10/1991 | Packard et al. | 530/390 |
| 5,154,918 | 10/1992 | Maignan et al. | 424/72 |
| 5,344,917 | 9/1994 | Furukawa et al. | 530/356 |
| 5,412,076 | 5/1995 | Gagnieu | 530/356 |
| 5,683,701 | 11/1997 | Maes et al. | 424/401 |

FOREIGN PATENT DOCUMENTS

| | | |
|---|---|---|
| 0499194 | 8/1992 | European Pat. Off. . |
| 0548946 | 6/1993 | European Pat. Off. . |
| 63-191829A | 8/1988 | Japan . |
| 7-316287A | 12/1995 | Japan . |
| 9-268469A | 10/1997 | Japan . |
| 9-268470A | 10/1997 | Japan . |

OTHER PUBLICATIONS

Hikaku Kaguku (Leather Chemistry), Yasumasa Chonan et al., vol. 28, No. 3, p. 175, 1982.

Seitai Zairyo (Material of Living Body), Yasuyoshi Miyachi et al., vol. 16, No. 1, p. 7, 1998.

*Primary Examiner*—Christopher S. F. Low
*Assistant Examiner*—Abdel A. Mohamed
*Attorney, Agent, or Firm*—John P. White; Cooper & Dunham LLP

[57] ABSTRACT

The present invention provides a regenerated collagen fiber exhibiting a draping, luster and feel close to those of a natural protein fiber such as a human hair and capable of application of a permanent wave treatment, and a method of manufacturing the regenerated collagen fiber. The amino group and/or carboxyl group of the regenerated collagen is chemically modified to introduce a mercapto group and/or a disulfide linkage to the regenerated collagen. When subjected to a permanent wave treatment, the regenerated collagen fiber retains the waved shape.

10 Claims, No Drawings

REGENERATED COLLAGEN FIBER AND METHOD OF MANUFACTURING THE SAME

BACKGROUND OF THE INVENTION

The present invention relates to a regenerated collagen fiber having a mercapto group and/or disulfide linkage and a method of manufacturing the same. The regenerated collagen fiber of the present invention has a mercapto group and/or a disulfide linkage and, thus, can be optionally deformed by a redox reaction. In addition, the deformed shape can be retained. Thus, the regenerated collagen fiber of the present invention can be used as a substitute for human hair, animal hair and as a catgut.

In general, the skin or bone of an animal is used as a raw material in the manufacture of a regenerated collagen fiber. The raw material is treated with an alkali or enzyme to decompose and remove the telopeptide portion of the collagen so as to make the collagen soluble in water. Then, the solubilized collagen is spun to prepare a regenerated collagen fiber. The regenerated collagen fiber, which exhibits a high mechanical strength among the protein fibers like silk, is widely used in various fields. Particularly, the regenerated collagen fiber, which is a protein fiber having a characteristic molecular structure, is close to human hair, which is also a natural protein fiber having a very complex fine structure, in draping, luster and feel. Such being the situation, various attempts are being made to use the regenerated collagen fiber for the manufacture of animal hair-like fibers used as a substitute for a human hair and fur.

In general, the cysteine residue and cystine residue within the natural collagen molecule are present in the telopeptide portion. Thus, the regenerated collagen fiber molecule after removal of the telopeptide portion is substantially free from the cysteine residue or cystine residue, making it impossible to apply a permanent wave treatment to the regenerated collagen fiber unlike the human hair. The term "permanent wave treatment" denotes the chemical treatment applied to the human hair in, for example, a beauty salon for modifying an optional shape, which can be retained, to the human hair by utilizing a redox reaction.

For modifying the regenerated collagen fiber, various measures have already been reported including, for example, a chemical modification and a treatment using a metal crosslinking agent. However, an attempt to introduce a mercapto group or a disulfide linkage to the regenerated collagen fiber has not yet been reported. As described previously, the regenerated collagen fiber retains to some extent the molecular structure inherent in collagen. However, the molecules of the regenerated collagen are arranged irregularly. It has not yet been clarified whether or not a permanent wave treatment can be applied to the regenerated collagen fiber of the special fiber structure in the case of introducing a mercapto group and/or a disulfide linkage to the regenerated collagen fiber.

Various synthetic fibers are also proposed for use as a substitute for the human hair. For example, proposed as a synthetic fiber in Japanese Patent Disclosure (Kokai) No. 63-191829 is a polyamino acid having a mercapto group or a disulfide linkage attached to the side chain of the polymer. It is described that a permanent wave treatment can be applied satisfactorily to the particular synthetic fiber. Similarly, a polyamino acid derivative is disclosed in, for example, Japanese Patent Disclosure No. 7-316287. However, each of the synthetic fibers disclosed in these prior arts consists of a limited number of amino acids and widely differs in the fiber structure from the regenerated collagen fiber of the present invention. It should also be noted that these methods for introducing a mercapto group or a disulfide linkage is applied to synthetic fibers which can be subjected to severe reacting conditions and which are prepared from the raw material amino acids which can be obtained easily. Therefore, it was impossible to apply these methods to the regenerated collagen fiber made of natural proteins and, thus, tending to be denatured.

BRIEF SUMMARY OF THE INVENTION

An object of the present invention is to provide a regenerated collagen fiber exhibiting a draping, luster and feel close to those of the natural protein fiber such as a human hair and capable of application of a permanent wave treatment.

As a result of an extensive research, the present inventors have found it possible to introduce a mercapto group and/or a disulfide linkage into a collagen molecule by means of a chemical modification method using diamine and/or halogenated aldehyde and/or epoxy compound, arriving at the present invention which permits obtaining a regenerated collagen fiber to which a permanent wave treatment can be applied.

According to a first aspect of the present invention, there is provided a regenerated collagen fiber having a mercapto group and/or a disulfide linkage.

It is desirable for the sulfur content of the mercapto group and/or disulfide linkage to fall within a range of between 0.3 and 5.1% by weight based on the amount of the collagen. More preferably, the content of the divalent sulfur should fall within a range of between 0.5 and 5.4% by weight of the collagen.

According to a second aspect of the present invention, there is provided a method of manufacturing a regenerated collagen fiber comprising the step of introducing a mercapto group and/or a disulfide linkage to an amino group and/or a carboxyl group of collagen by means of chemical modification.

In the present invention, it is possible to employ an amidation reaction between collagen and a diamine having a disulfide linkage in the presence of a condensation agent. Also, it is desirable to carry out the amidation reaction after the regenerated collagen fiber is dried.

It is also possible to treat the regenerated collagen with an aqueous solution of aldehyde, thiosulfate and/or hydrosulfide. Further, a mercapto group and/or a disulfide linkage can be introduced to the regenerated collagen by treating collagen with an epoxy compound and a sulfur-containing compound.

Of course, at least two of the treatments exemplified above can be employed in combination.

Further, after a mercapto group and/or a disulfide linkage has been introduced to the amino group and/or the carboxyl group of collagen by means of chemical modification, it is possible to treat the resultant modified collagen with an aqueous solution of a metal salt.

DETAILED DESCRIPTION OF THE INVENTION

A mercapto group and/or a disulfide linkage can be introduced by chemical modification to, particularly, the amino group and carboxyl group among the various functional groups present in the collagen molecule. The mercapto group or the disulfide linkage is introduced into the collagen molecule such that the amount of sulfur contained in these mercapto group or disulfide linkage falls within a range of between 0.3 and 5.1% by weight, preferably between 0.7 and 5.1% by weight, and more preferably between 1.0 and 5.1% by weight of collagen. If the sulfur content is less than 0.3% by weight, a permanent wave treatment cannot be applied satisfactorily to the resultant regenerated collagen fiber. If the sulfur content exceeds 5.1% by weight, however, the amino group and carboxyl group of collagen cannot be modified chemically, with the result that a large proportion of the added sulfur is attached to the surface or inner portion of the fiber. In short, the sulfur content failing to fall within the range specified in the present invention is not practical in improving the permanent wave treatment effect.

Originally, a mercapto group or a disulfide linkage is scarcely contained in the regenerated collagen fiber. However, thioether derived from methionine residue is present in the regenerated collagen fiber and, thus, the regenerated collagen fiber to which a chemical modification is not applied contains about 0.2 to 0.3% by weight of divalent sulfur. Such being the situation, it is desirable for the regenerated collagen fiber of the present invention to have a divalent sulfur content of 0.5 to 5.4% by weight, preferably 0.9 to 5.4% by weight, and more preferably 1.1 to 5.4% by weight. If the divalent sulfur content is less than 0.5% by weight, it is hardly possible to obtain a satisfactory permanent wave treatment effect. If the divalent sulfur content exceeds 5.4% by weight, however, the amino group and carboxyl group present in collagen are not chemically modified, with the result that a large proportion of the added sulfur is attached to the surface or inner portion of the fiber. In short, the divalent sulfur content failing to fall within the range specified in the present invention is not practical in improving the permanent wave treatment effect.

Where the regenerated collagen fiber is crosslinked with a cation of metal such as chromium, titanium, aluminum or zirconium, it is possible to use a sulfate of the metal. In this case, the tetravalent sulfur of the sulfate ion is present within the fiber, with the result that it is possible for the sulfur content of collagen to exceed 5.4% by weight. However, what is required for improving the permanent wave treatment effect is a divalent sulfur such as a mercapto group and/or disulfide linkage. Naturally, the divalent sulfur content does not exceed 5.4% by weight regardless of the presence of the tetravalent sulfur.

In the present invention, it is desirable to use a base hide portion as a raw material of the regenerated collagen, said base hide portion being obtained from a raw hide of animals such as cattle, either fresh or salted. The base hide, which essentially consists of an insoluble collagen, is generally used after removal of the flesh portion attached in a mesh form and the salt used for preventing the base hide from being rotted or deteriorated.

Impurities such as glycerides, lipids including phospholipid and free fatty acid, and proteins other than collagen such as glycoproteins and albumin are present in the insoluble collagen. Since these impurities markedly affect adversely the spinning stability, luster, degree of strong elongation, and odor in converting the regenerated collagen into fibers, it is desirable to remove these impurities by applying a treatment widely employed for treating hides. For example, the raw hide is dipped in lime water to hydrolyze the fat and oil in the insoluble collagen to loosen the collagen structure, followed by, for example, an acid-alkali treatment, an enzyme treatment or a solvent treatment.

A solubilizing treatment for cutting the crosslinked peptide portion is applied to the insoluble collagen after the treatments noted above. A known alkali solubilizing method or enzyme solubilizing method can be employed in the present invention as a method of the solubilizing treatment.

In the case of employing an alkali solubilizing method, it is desirable to employ neutralization with an acid such as hydrochloric acid. Incidentally, an improved method of the known alkali solubilizing method is disclosed in, for example, Japanese Patent Publication (Kokoku) No. 46-15033.

The enzyme solubilizing method referred to previously, which permits obtaining a regenerated collagen of uniform molecular weight, can be employed satisfactorily in the present invention. To be more specific, the enzyme solubilizing method disclosed in, for example, Japanese Patent Publication No. 43-25829 or Japanese Patent Publication No. 43-27513 can be employed in the present invention. Incidentally, both the alkali solubilizing method and the enzyme solubilizing method can be employed in combination in the present invention.

It is desirable to apply additional treatment such as pH adjustment, salting-out, water wash or solvent treatment to the collagen subjected to the solubilizing treatment, because the particular additional treatment permits improving the quality of the resultant regenerated collagen.

In order to obtain a stock solution containing a predetermined concentration, e.g., 1 to 15% by weight, preferably 2 to 10% by weight, of collagen, the resultant soluble collagen is dissolved in an acidic solution having the pH value adjusted at 2 to 4.5 with an acid such as hydrochloric acid, acetic acid or lactic acid. The resultant aqueous collagen solution may be subjected to a defoaming treatment by stirring under a reduced pressure or may be filtered, in order to remove fine dust insoluble in water, as desired. Further, additives such as a stabilizer and a water-soluble high molecular compound may be added in suitable amounts to the aqueous solution of the soluble collagen, as required, in order to improve, for example, the mechanical strength, resistance to water and heat, luster, and spinning properties of the regenerated collagen, and to prevent the regenerated collagen from being colored and rotted.

Aqueous solution of the solubilized collagen is injected through a spinning nozzle or a slit into an aqueous solution of an inorganic salt so as to be dipped in the salt and, thus, to obtain a regenerated collagen fiber. The aqueous solution of the inorganic salt used in the present invention includes, for example, an aqueous solution of a water-soluble inorganic salt such as sodium sulfate, sodium chloride or ammonium sulfate. In general, the inorganic salt concentration is controlled to fall within a range of between 10% by weight and 40% by weight. It is desirable adjust the pH value of the aqueous solution of the inorganic salt to fall within a range of between 2 and 13, preferably between 4 and 12 by adding a metal salt such as sodium borate or sodium acetate, hydrochloric acid, acetic acid, boric acid or sodium hydroxide. Where the pH value of the aqueous solution is less than 2 or exceeds 13, the peptide bond of the collagen is likely to be hydrolyzed, resulting in failure to obtain a desired fiber. The temperature of the aqueous solution of the inorganic salt, which is not particularly specified in the present invention, is desirably be 35° C. or less in general. If the temperature noted above is higher than 35° C., the soluble collagen is denatured, or the spun fiber fails to exhibit a sufficiently high mechanical strength, making it difficult to perform the spinning operation with a high stability. Incidentally, the lower limit of the temperature in question, which is not particularly limited in the present invention, should generally be controlled appropriately in view of the solubility of the inorganic salt.

A treatment to make the regenerated collagen insoluble may be applied as required by using a crosslinking agent. The crosslinking agent used in the present invention includes, for example, monoaldehydes such as formaldehyde, acetaldehyde, methyl glyoxal, acrolein, and crotonaldehyde; dialdehydes such as glyoxal, malondialdehyde, succindialdehyde, glutaraldehyde, and dialdehyde starch; alkylene oxides such as ethylene oxide and propylene oxide; epoxy compounds including glycidyl ethers of aliphatic alcohol, glycol and polyols, and glycidyl esters of monocarboxylic acid, dicarboxylic acid, and polycarboxylic acid; N-methylol compounds derived from urea, melanin, acrylamide, acrylic acid amide and polymers thereof; water soluble polyurethanes prepared by introducing isocyanate into a polyol or a polycarboxylic acid, followed by adding sodium hydrogen sulfite; triazine derivatives such as monochlorotriazine and dichlorotriazine; sulfate ester of oxyethyl sulfone or derivatives of vinyl sulfone; trichloropyridine derivatives; dichloroquinoxaline derivatives; N-methylol derivatives; isocyanate compounds, phenol derivatives; aromatic compounds having a hydroxyl group such as tannin; and cations of metals such as aluminum, chromium, titanium and zirconium. Where the crosslinking treatment is not performed, it is possible to treat the regenerated collagen fiber with an aqueous solution containing a high concentration of a salt, organic solvents such as water-soluble alcohols, ketones, and aqueous solution thereof. Alternatively, the regenerated collagen fiber, which is stored, may be dried for use in the present invention. Further, dried regenerated collagen fiber may be treated with another organic solvent or an aqueous solution of the organic solvent or may be stored for use in the present invention.

In the present invention, it is possible to apply, as desired, washing with water or a lubricant treatment to the regenerated collagen fiber. The water wash is effective for preventing the lubricant from being precipitated by the action of the salt and for preventing the salt from being precipitated from the regenerated collagen fiber in the drying step. Where the salt is precipitated, the regenerated collagen fiber tends to be broken. Further, the precipitated salt tends to scattered within the drying apparatus so as to be attached to a heat exchanger arranged within the drying apparatus so as to lower the heat transmitting coefficient. On the other hand, in the case of applying a lubricant treatment, the regenerated collagen fiber is prevented more effectively from being caused to hang-up in the drying step.

In the present invention, a mercapto group and/or a disulfide linkage is introduced by chemical modification into the fibrous regenerated collagen fiber described above. The chemical modification method employed in the present invention includes (A) a method of chemically modifying a carboxyl group, and (B) a method of chemically modifying an amino group, as described in detail in the following:

(A) For modifying the carboxyl group of collagen, an amidation reaction is carried out between the regenerated collagen fiber and a diamine represented by general formula (I):

$$H_2N(CH_2)_nSS(CH_2)_mNH_2 \quad (I)$$

where each of n and m is an integer of 1 to 4, or represented by general formula (II):

$$H_2NCH(COOR_1)CH_2SSCH_2CH(COOR_2)NH_2 \quad (II)$$

where each of $R_1$ and $R_2$ represents an alkyl group having 1 to 4 carbon atoms or a benzyl group.

The specific examples of the diamine represented by general formula (I) includes, for example, cystamine, cystamine dihydrochloride, and cystamine sulfate. On the other hand, the specific examples of the diamine represented by general formula (II) include, for example, D-cystine methyl ester, L-cystine methyl ester, a mixture of D- and L-cystine methyl esters, D-cystine ethyl ester, L-cystine ethyl ester, a mixture of D- and L-cystine ethyl esters, D-cystine propyl ester, L-cystine propyl ester, a mixture of D- and L-cystine propyl esters, D-cystine butyl ester, L-cystine butyl ester, a mixture of D- and L-cystine butyl esters, D-cystine benzyl ester, L-cystine benzyl ester, and a mixture of D- and L-cystine benzyl esters.

The amidation reaction is carried out by dipping the regenerated collagen fiber in a reaction solvent dissolving the diamines represented by general formulas (I) and/or (II) and a condensation agent. The amount of the diamine compound represented by general formula (I) and/or (II) is desirably 0.05 mmol or more, preferably 0.6 mmol or more, and more preferably 1.2 mmol or more per gram of collagen. On the other hand, the amount of the condensation agent is desirably 0.1 mmol or more, preferably 1.2 mmol or more per gram of collagen. If the amounts of these diamine compound and condensation agent are less than the lower limits noted above, it is hardly possible to ensure a sulfur content high enough to permit the regenerated collagen fiber to produce a permanent wave treating effect. The dipping treatment is desirably carried out under a temperature of 80° C. or less for 5 minutes or more. If the treating temperature exceeds 80° C., the regenerated collagen fiber tends to be denatured, resulting in a low mechanical strength of the produced fiber. It follows that it is difficult to spin the fiber stably.

The condensation agent used in the present invention includes, for example, carbodiimides such as 1-ethyl-3-(3'-dimethylaminopropyl) carbodiimide and its hydrochloride, 1-benzyl-3-(3'-dimethylaminopropyl) carbodiimide and its hydrochloride, 1-cyclohexyl-3-(2-morpholinoethyl) carbodiimide.meso-p-toluenesulfonate, N,N'-diisopropylcarbodiimide, N,N'-dicyclohexylcarbodiimide; phosphorus compounds such as benzotriazol-1-yl-oxy-tris (dimethylamino)phosphonium hexafluorophosphate and diphenyl phosphoryl azide; N,N'-carbonyl diimidazole, and 2-ethoxy-1-ethoxycarbonyl-1,2-dihydroquinoline. These condensation agents can be used singly or in combination. Also, in order to promote the reaction and to suppress the side reaction, it is possible to use, for example, N-hydroxysuccinimide, 1-hydroxy benzotriazole, 3-hydroxy-4-oxo-3,4-dihydro-1,2,3-benzotriazine in combination with the condensation agent exemplified above.

The solvent used in the present invention for carrying out the amidation reaction includes, for example, water; alcohols such as methyl alcohol, ethyl alcohol, and isopropanol; ethers such as tetrahydrofuran and dioxane; halogenated organic solvents such as dichloromethane, chloroform and carbon tetrachloride; and neutral organic solvents such as DMF and DMSO. These compounds can be used in combination in the form of a mixed solvent. Where water is used as a reaction solvent, it is possible to use an aqueous solution of an inorganic salt such as sodium sulfate, sodium chloride or ammonium sulfate, as required. Also, it is possible to adjust the pH value of the reaction solvent by adding, for example, metal salts such as sodium borate and sodium acetate as well as hydrochloric acid, boric acid, acetic acid and sodium hydroxide. In the present invention, the pH value of the reaction system should desirably fall within a range of between 3.0 and 7.0.

It is desirable to carry out the amidation reaction after the regenerated collagen fiber is once dried. Even if the amidation reaction is carried out without drying the regenerated collagen fiber, the mercapto group and the disulfide linkage can be chemically modified, making it possible to apply a permanent wave treatment to the regenerated collagen fiber of the present invention. However, the permanent wave treating effect is further improved, if the amidation reaction is carried out after drying of the regenerated collagen fiber. A higher order structure of the collagen molecule such as an agglomeration structure or fiber structure is irreversibly changed if the regenerated collagen fiber is dried. It is considered reasonable to understand that the permanent wave treating effect can be further improved by subjecting the regenerated collagen fiber whose structure has been changed by the drying to the amidation reaction.

It is desirable to apply the drying treatment under a temperature of 120° C. or less. If the drying temperature exceeds 120° C., regenerated collagen fiber tends to be denatured, resulting in a lowered mechanical strength of the obtained fiber. It follows that it is difficult to spin the fiber stably.

(B) The amino group of collagen can be chemically modified by using (1) a halogenated aldehyde compound or (2) an epoxy compound, as described in detail in the following.

(1) Where a halogenated aldehyde compound is used for the chemical modification, 1̂ the regenerated collagen fiber is treated first with an aldehyde represented by general formula (III):

$$X_nRCHO \quad \text{(III)}$$

where X denotes a halogen atom, R represents a hydrocarbon radical having at most 3 carbon atoms, and n is an integer of 1 to 3, then, the collagen is further treated with an aqueous solution of a thiosulfate and/or hydrosulfide; or 2̂ alternatively, a reaction is carried out between the aldehyde represented by general formula (III) and the thiosulfate and/or hydrosulfide, followed by treating the regenerated collagen fiber with the reaction mixture.

The halogen X included in general formula (III) includes, for example, fluorine, chlorine, bromine and iodine. The hydrocarbon radical R included in general formula (III) includes, for example, a methyl group, an ethyl group, and a propyl group.

Further, the aldehydes represented by general formula (III) include, for example, 2-chloroacetoaldehye, 2-bromoacetoaldehyde, trichloroacetoaldehyde, 3-fluoropropionealdehyde, 2-fluoropropionaldehyde, 3-chloropropionaldehyde, 2-chloropropionaldehyde, 3-bromopropionaldehyde, 2-bromopropionaldehyde, 3-iodopropionaldehyde, 2-iodopropionaldehyde, 4-fluorobutylaldehyde, 3-fluorobutylaldehyde, 2-fluorobutylaldehyde, 4-chlorobutylaldehyde, 3-chlorobutylaldehyde, 2-chlorobutylaldehyde, 4-bromobutylaldehyde, 3-bromobutylaldehyde, 2-bromobutylaldehyde, 4-iodobutylaldehyde, 3-iodobutylaldehyde, 2-iodobutylaldehyde, 3-fluoro-2-methylpropionealdehyde, 3-chloro-2-methylpropionaldehyde, 3-bromo-2-methylpropionaldehyde, 3-iodo-2-methylpropionaldehyde, 3-fluoroacrolein, 3-chloloacrolein, 3-bromoacrolein, 3-iodoacrolein, 4-fluorocrotonaldehyde, 4-chlorocrotonaldehyde, 4-bromocrotonaldehyde, and 4-iodocrotonaldehyde. Particularly, it is desirable to use 2-chloroacetoaldehyde which has a high solubility in water and which is available at a low cost.

The thiosulfates used in the present invention include, for example, sodium thiosulfate, potassium thiosulfate, and calcium thiosulfate. Further, the hydrosulfides used in the present invention include, for example, sodium hydrosulfide, potassium hydrosulfide, calcium hydrosulfide and ammonium hydrosulfide. Of course, the thiosulfates, hydrosulfides, etc. used in the present invention are not limited to the compounds exemplified above.

In the method (1)-1̂, reaction is considered to take place first between the amino group of collagen and the aldehyde group of the aldehyde compound represented by general formula (III), followed by carrying out a substitution reaction between a chloride and an anion of the thiosulfate or hydrosulfide so as to introduce a mercapto group into collagen.

In general, the regenerated collagen fiber is dipped in an aqueous solution of the aldehyde represented by general formula (III) so as to carry out the reaction described above. The amount of the aldehyde is 0.4 mmol or more per gram of collagen, and the aldehyde concentration should be set at 0.05 to 10% by weight, preferably 0.1 to 8% by weight, and more preferably 0.2 to 5% by weight. If the aldehyde concentration is lower than 0.05% by weight, the number of reacting points is decreased and, thus, the reaction between collagen and amino group is unlikely to proceed sufficiently. If the aldehyde concentration exceeds 10% by weight, the reaction between the aldehyde and the amino group certainly proceeds sufficiently. However, it is difficult to handle industrially the reaction system. In addition, it is not preferable from the view point of the environment, if the aldehyde concentration exceeds 10% by weight.

It is desirable for the pH value of the aqueous solution of aldehyde to fall within a range of between 4 and 13, preferably between 6 and 9. If the pH value is less than 4, the reaction with the amino group of the collagen gets slower or hardly proceeds. If the pH value exceeds 13, the peptide bond of collagen tends to be hydrolyzed, resulting in failure to obtain a desired fiber. Also, the pH value may be adjusted as desired because the pH value of the aldehyde aqueous solution is lowered with time.

It is desirable for the regenerated collagen fiber to be treated with the aqueous solution of aldehyde at a temperature of 50° C. or less and for 5 minutes or more. If the treating temperature exceeds 50° C., the regenerated collagen fiber tends to be denatured, resulting in failure to obtain a fiber having a sufficiently high mechanical strength. It follows that it is difficult to manufacture collagen strings with a high stability.

The regenerated collagen fiber after reaction with aldehyde is then dipped in an aqueous solution of thiosulfate and/or hydrosulfide. The concentration of the thiosulfate or hydrosulfide is 0.1 to 40% by weight. The treating temperature should be 50° C. or less. Further, the dipping time is 5 minutes or more.

In the method (1)-2̂, a substitution reaction is considered to be carried out first between a chloride of the aldehyde represented by general formula (III) and an anion of thiosulfate or hydrosulfide, followed by carrying out a reaction between the aldehyde group and the amino group of the collagen molecule so as to introduce a mercapto group into the collagen molecule. In this method, the aldehyde compound represented by general formula (III) is mixed with a thiosulfate and/or hydrosulfide for the desired reaction. The amount of the aldehyde compound is 0.4 mmol or more per gram of collagen. Also, the concentration of the aldehyde compound is controlled to fall within a range of between 0.05 and 10% by weight, preferably between 0.1 and 8% by weight, and more preferably between 0.2 and 5% by weight. Then, a thiosulfate and/or hydrosulfide in a molar amount equal to that of the aldehyde compound are added to the aldehyde-containing solution while stirring. The stirring is carried out for 0 to 24 hours, preferably for 1 to 6 hours. Then, the regenerated collagen fiber is dipped in the reaction solution. In this step, the pH value of the reaction system is desirably 4 to 13, preferably 6 to 9. The treating temperature is 50° C. or less and the dipping time of the regenerated collagen fiber is 5 minutes or more.

Where a thiosulfate is used in each of the methods (1)-$\hat{1}$ and (1)-$\hat{2}$, the resultant regenerated collagen fiber is required to be further treated with an aqueous solution of an acid or mercapto ethanol. In the case of using an acid, the pH value is adjusted at 2 to 6 with, for example, hydrochloric acid, sulfuric acid or boric acid, and the treatment is carried out under a temperature of at 50° C. or less. Also, the regenerated collage fiber is kept dipped in the acid for 5 minutes or more. When it comes to the treatment with an aqueous solution of mercapto ethanol, the mercapto ethanol concentration is 0.1% or more, and the treatment is carried out under a temperature of 50° C. or less. Further, the regenerated collage fiber is kept dipped in the solution for 5 minutes or more.

(2) Where an epoxy compound is used for the chemical modification, the regenerated collagen fiber is treated with an epoxy compound and a sulfur-containing compound. In this method, a polyfunctional epoxy compound is considered to carry out reaction with the amino group of the collagen molecule and with sulfur-containing compound so as to introduce a mercapto group into the collagen compound. In this case, it suffices to dip the regenerated collagen fiber in the epoxy compound and, then, in the sulfur-containing compound. The order of the dipping treatment can be determined appropriately, as required. Alternatively, it is also possible to carry out first the reaction between the epoxy compound and the sulfur-containing compound, followed by dipping the regenerated collagen fiber in the resultant reaction mixture.

The epoxy compound used in the present invention has at least two epoxy groups and includes, for example, polyglycidyl ethers of glycol, polyglycol, sorbitol, polysorbitol, glycerol, polyglycerol, or other polyols; polyglycidyl esters which are glycidyl esters of dicarboxylic acid, or polycarboxylic acids.

The sulfur-containing compound used in the present invention includes, for example, hydrosulfides such as sodium hydrosulfide, potassium hydrosulfide, and ammonium hydrosulfide; thiosulfates such as sodium thiosulfate and potassium thiosulfate; amines having a mercapto group such as cysteamine and cysteine; and amines having a disulfide linkage such as cystamine, cystine, cystine methyl ester, cystine ethyl ester, cystine propyl ester, cystine butyl ester and cystine benzyl ester.

Where an epoxy compound is allowed to react with the amino group of collagen or sulfur-containing compound, a catalyst or a reaction accelerator can be used as desired. The catalyst used in the present invention includes, for example, amines and imidazoles. These amines include, for example, tertiary amines such as triethylenediamine, tetramethylguanidine, triethanol amine, N,N-dimethylpiperazine, benzyldimethylamine, dimethylaminomethylphenol, 2,4,6-tris (dimethylaminomethyl)phenol; secondary amines such as piperazine and morpholine; and quaternary ammonium salts such as tetramethylammonium salt, tetraethylammonium salt, and benzyltriethylammonium salt. On the other hand, the imidazoles used as a catalyst in the present invention include, for example, 2-methylimizadole, 2-ethylimidazole, 2-isopropylimidazole, 1-cyanoethyl-2-methylimidazole, 1-cyanoethyl-2-ethylimidazole, 1-cyanoethyl-2-isopropylimidazole, and 2-ethyl-4-methylimidazole. Further, the reaction accelerator used in the present invention includes, for example, salicylic acid or a metal salt of salicylic acid; thiocyanates such as ammonium thiocyanate; tetramethylthiuram disulfide; and thiourea.

The solvent used for the reaction of the epoxy compound and/or sulfur-containing compound includes, for example, water, alcohols such as methyl alcohol, ethyl alcohol, and isopropanol; ethers such as tetrahydrofuran, and dioxane; halogenated organic solvents such as dichloromethane, chloroform, and carbon tetrachloride; and neutral solvents such as DMF and DMSO. These solvents can be used singly or in the form of a mixed solvent. In the case of using water as a solvent, it is possible to use an aqueous solution of an inorganic salt, as required, such as sodium sulfate, sodium chloride or ammonium sulfate. In general, the inorganic salt concentration is controlled at 10 to 40% by weight. Also, it is possible to adjust the pH value of the aqueous solution by adding, for example, a metal salt such as sodium borate or sodium acetate as well as hydrochloric acid, acetic acid, or sodium hydroxide. In carrying out reaction of an epoxy compound, the pH value is desirably adjusted at 3 to 12, preferably 7–12. If the pH value is lower than 3, the reaction rate is very low in spite of use of a catalyst.

As a general condition of the dipping treatment carried out in the present invention, the amount of the epoxy compound is desirably 0.1 mmol or more, preferably 1.0 mmol or more per gram of collagen in terms of the epoxy group. On the other hand, the amount of the sulfur-containing compound is 0.1 mmol or more, preferably 1.0 mmol or more per gram of collagen in terms of the sulfur amount. Each of the epoxy compound and the sulfur-containing compound is desirably treated under a temperature of 80° C. or less for one minute or more. Where the epoxy compound and the sulfur-containing compound are mixed first for carrying out the reaction therebetween, the mixing time is desirably one minute or more. Also, the regenerated collagen fiber is desirably treated in the resultant reaction mixture at a temperature of 50° C. or less for one minute or more.

Where an epoxy compound is used together with a hydrosulfide as a sulfur-containing compound, a reaction between the regenerated collagen fiber and the epoxy compound is carried out first, and then with the hydrosulfide. In this case, a reaction between the amino group of the regenerated collagen fiber and the epoxy compound is considered to take place first and, then, the hydrosulfide is considered to convert the unreacted epoxy group into a mercapto group.

In the present invention, it is desirable to use a hydrosulfide in an amount of 0.1 mmol or more per gram of collagen in terms of the sulfur amount. If the sulfur amount is smaller than the value noted above, it is difficult to ensure a sulfur amount large enough to enable the regenerated collagen fiber to produce a permanent wave treating effect.

In the method using the hydrosulfide, the collagen fiber is dipped in, for example, a solution containing an epoxy compound. The amount of the epoxy compound is desirably 3 mmol or more per gram of collagen, the reaction temperature is desirably 50° C. or less, and the dipping time is desirably 5 minutes or more.

After the treatment with the epoxy compound, the regenerated collagen fiber may be washed with water, may be treated with a lubricant, or may be dried, as required. Then, unreacted epoxy group is converted to mercapto group by hydrosulfide treatment. Concerning the reacting conditions, the sulfur content is 1 mmol or more per gram of collagen, the reaction temperature is 80° C. or less, and the dipping time is one minute or more. It is possible to use water as a solvent. It is also possible to use, as required, an aqueous solution of a water-soluble inorganic salt such as sodium sulfate, sodium chloride or ammonium sulfate. Further, it is possible to adjust the pH value of the aqueous solution by adding a metal salt such as sodium borate or sodium acetate as well as hydrochloric acid, boric acid, acetic acid, sodium hydroxide or ammonia.

The epoxy compound can be used together with a sulfur-containing compound, i.e., diamines represented by general formula (I) and/or (II), which have a disulfide linkage. The specific diamine compounds have already been exemplified.

The amount of the diamine compound is desirably 0.1 mmol or more per gram of collagen. If the diamine compound is used in an amount smaller than the lower limit noted, it is difficult to ensure a sulfur content high enough to enable the regenerated collagen fiber to produce a permanent wave treating effect.

In using the diamine represented by general formula (I) and/or (II):

$\hat{1}$ Collagen is impregnated with the diamine represented by general formula (I) and/or (II), followed by carrying out a reaction between the diamine-impregnated collagen and an epoxy compound; or $\hat{2}$ Collagen is reacted first with an epoxy compound, and then with the diamine represented by general formula (I) and/or (II);

$\hat{3}$ A reaction is carried out first between an epoxy compound and the diamine represented by general formula (I) and/or (II), followed by carrying out a reaction between collagen and the reaction mixture.

In introducing a diamine compound having a disulfide linkage into the regenerated collagen, method $\hat{2}$ given above is preferred to method $\hat{1}$. Likewise, method $\hat{3}$ is preferred to method $\hat{1}$.

In method $\hat{1}$, the amino group of the diamine represented by general formula (I) and/or (II) is crosslinked with the amino group of collagen so as to introduce a mercapto group and/or a disulfide linkage into the collagen molecule. To be more specific, the regenerated collagen fiber is dipped in a solution of diamine represented by general formula (I) and/or (II) so as to permit the regenerated collagen fiber to be impregnated with the diamine represented by general formula (I) and/or (II), followed by treating the diamine-impregnated collagen with an epoxy compound. For allowing the regenerated collagen fiber to be impregnated with the diamine, the amount of diamine is desirably 1 mmol or more per gram of collagen in terms of the sulfur content, the impregnating temperature is desirably 50° C. or less, and the dipping time is one minute or more. In the subsequent treatment with an epoxy compound, the amount of the epoxy compound is desirably 3 mmol or more per gram of collagen, the treating temperature is desirably 50° C. or less, and the dipping time is desirably 5 minutes or more.

In method $\hat{2}$ noted above, a reaction is carried out first between the amino group of collagen and an epoxy compound, followed by carrying out a reaction between an unreacted epoxy group and the amino group of the diamine represented by general formula (I) and/or (II). To be more specific, the treatment with an epoxy compound is carried out by dipping the regenerated collagen fiber in a solution containing the epoxy compound. The amount of the epoxy compound should is desirably 3 mmol or more per gram of collagen in terms of the epoxy group, the reaction temperature is 50° C. or less, and the dipping time is 5 minutes or more. After the treatment with the epoxy compound, it may be washed with water, may be treated with a lubricant or may be dried, as required. Then, the regenerated collagen fiber is dipped in a solution containing a diamine compound represented by general formula (I) and/or (II). In this step, the amount of the diamine compound is desirably 1 mmol or more per gram of collagen in terms of the sulfur content, the treating temperature is desirably 50° C. or less, and the dipping time is desirably one minute or more. Incidentally, the catalyst or reaction accelerator used in the reaction of an epoxy compound can also be used, as desired.

In method $\hat{3}$, a reaction is carried out first between an epoxy compound and the amino group of the diamine represented by general formula (I) and/or (II), followed by adding collagen to the reaction mixture so as to carry out a reaction between the unreacted epoxy group and the amino group of the regenerated collagen fiber so as to introduce a mercapto group and/or a disulfide linkage to the regenerated collagen fiber. To be more specific, the reaction mixture is prepared from the reaction between the diamine compound represented by general formula (I) and/or (II) and the epoxy compound, the sulfur content being desirably at a level of 1 mmol or more per gram of collagen, and the amount of the epoxy group being desirably at a level of 3 mmol or more per gram of collagen. Therefore, the regenerated collagen fiber is dipped in the reaction mixture thus prepared. The reaction mixture is desirably prepared under a temperature of 50° C. or less over a reaction time of one minute or more. Further, the regenerated collagen fiber is desirably dipped in the reaction mixture under a temperature of 50° C. or less, and the dipping time is desirably 5 minutes or more.

Further, after the treatments described above, it is possible to carry out water wash, lubricant treatment, or drying, as required. Incidentally, the method using a hydrosulfide is preferable to the method using a diamine having a disulfide linkage in respect of the permanent wave treating effect produced by the regenerated collagen fiber.

To reiterate, the present invention covers method (A) using a diamine compound having a disulfide linkage, method (B)-(1) using a halogenated aldehyde compound, and method (B)-(2) using an epoxy compound. These methods can be employed singly. Alternatively, at least two methods can be employed in combination. Where a plurality of methods are employed in combination, the order of employing these methods need not be considered. It should be noted in particular that, if method (A) for modifying a carboxyl group is employed in combination with method (B) for modifying an amino group, a large number of mercapto groups and/or disulfide linkages are introduced to the resultant regenerated collagen fiber so as to improve the permanent wave treating effect.

As described above, the regenerated collagen fiber of the present invention, which has divalent sulfur such as mercapto group and/or disulfide linkage obtained by chemical modification of the regenerated collagen, is optionally deformed upon redox reaction. In addition, the deformed shape can be retained. What should also be noted is that the regenerated collagen fiber of the present invention exhibits a draping, luster and feel close to those of the natural protein fiber and, thus, can be suitably used as a substitute for human hair or animal hair which can be subjected to a permanent wave treatment satisfactorily.

Further, in order to decrease the water absorption rate and further improve the feel of the regenerated collagen fiber of the present invention, it is desirable to treat the regenerated collagen fiber with an aqueous solution of a metal salt so as to permit the metal to produce a crosslinking effect. The metal salts used in the present invention include, for example, chromium sulfate, aluminum sulfate, aluminum chloride, zirconium sulfate, stannous chloride, and stannic chloride. Particularly, it is desirable to use chromium sulfate to allow the chromium metal to produce a crosslinking effect. In general, these metal salts are used singly. However, it is also possible to use a plurality of these metal salts in combination. The concentration of the aqueous solution is desirably 0.05 to 10% by weight, more preferably 0.2 to 5% by weight, in terms of the metal oxide. Concerning the treating condition, the temperature of the aqueous solution of the metal salt should is desirably 60° C. or less, preferably 15° C. to 40° C. for 8 hours or more.

EXAMPLES

The present invention is illustrated by Examples. Needless to say, however, the present invention is not limited by the Examples which follow. In the following Examples, mercapto group is represented by SH group and disulfide linkage is represented by S—S linkage.

(A) Preparation of Regenerated Collagen Fiber

Cattle base hide used as a raw material was solubilized with an alkali, followed by dissolving the raw material in an aqueous solution of lactic acid to obtain a stock solution. The stock solution was adjusted at a pH value of 3.5 and a collagen concentration of 6% by weight and, then, stirred under a reduced pressure to defoam, followed by transferring the resultant solution into a piston type spinning stock solution tank. The solution was left to stand under a reduced pressure for a further defoaming purpose. The stock solution thus prepared was extruded with a piston, and a predetermined amount of the extruded stock solution was pumped out by a gear pump to allow the stock solution to pass through a sintered filter having a pore diameter of 10 $\mu$m. The filtrate was further passed through a spinning nozzle having 50 pores each having a diameter of 0.35 mm and a length of 0.5 mm so as to be injected at a spinning rate of 4 m/min into a coagulating bath of 25° C. containing 20% by weight of sodium sulfate. The pH value of the coagulating bath was adjusted in advance at 11 by boric acid and sodium hydroxide.

(B) Lubricant Treatment

The resultant fiber was washed with water and, then, dipped in a bath filled with a lubricant consisting of an amino denatured silicone emulsion and a Pluronic type polyether type antistatic agent so as to allow the lubricant to adhere to the fiber.

Example 1

A regenerated collagen fiber was prepared by method (A) described above. The resultant fiber was kept dipped for 24 hours at 25° C. in an aqueous solution, the pH value of which was adjusted at 4.5 with hydrochloric acid and sodium hydroxide, containing 10% by weight of cystamine dihydrochloride, 3.5% by weight of 1-ethyl-3-(3'-dimethylaminopropyl)carbodiimide hydrochloride and 15% by weight of sodium sulfate, followed by washing the fiber with water.

Then, the resultant fiber was kept dipped for 30 minutes at 25° C. in an aqueous solution, the pH value of which was adjusted at 9 with boric acid and sodium hydroxide, containing 1.0% by weight of formaldehyde and 15% by weight of sodium sulfate.

Further, a lubricant treatment was applied to the resultant fiber by method (B) described above, followed by drying the fiber using a convection oven of 75° C. while putting the fiber under tension.

Example 2

A regenerated collagen fiber was prepared by method (A) described above.

Then, the resultant fiber was kept dipped for 30 minutes at 25° C. in an aqueous solution, the pH value of which was adjusted at 9 with boric acid and sodium hydroxide, containing 1.0% by weight of formaldehyde and 15% by weight of sodium sulfate, followed by washing the fiber with water.

The fiber thus prepared was kept dipped for 24 hours at 25° C. in an aqueous solution, the pH value of which was adjusted at 4.5 with hydrochloric acid and sodium hydroxide, containing 10% by weight of cystamine dihydrochloride, and 3.5% by weight of 1-ethyl-3-(3'-dimethylaminopropyl)carbodiimide hydrochloride.

Further, a lubricant treatment was applied to the resultant fiber by method (B) described above, followed by drying the fiber using a convection oven of 75° C. while putting the fiber under tension.

Example 3

A regenerated collagen fiber was prepared by method (A) described above.

Then, the resultant fiber was kept dipped for 30 minutes at 25° C. in an aqueous solution, the pH value of which was adjusted at 9 with boric acid and sodium hydroxide, containing 1.0% by weight of formaldehyde and 15% by weight of sodium sulfate. Then, a lubricant treatment was applied to the resultant fiber by method (B) described above, followed by drying the fiber using a convection oven of 75° C. while putting the fiber under tension.

The fiber thus prepared was kept dipped for 24 hours at 25° C. in an aqueous solution, the pH value of which was adjusted at 4.5 with hydrochloric acid and sodium hydroxide, containing 10% by weight of cystamine dihydrochloride, and 3.5% by weight of 1-ethyl-3-(3'-dimethylaminopropyl)carbodiimide hydrochloride, followed by washing the fiber with water and subsequently drying the fiber using a convection oven of 75° C. while putting the fiber under tension.

Example 4

A regenerated collagen fiber was obtained by applying an insolubilizing treatment to the fiber with a formaldehyde solution, followed by drying the fiber, as in Example 3. The fiber thus prepared was kept dipped for 24 hours at 25° C. in methanol containing 3.5% by weight of cystamine dihydrochloride and 3.5% by weight of dicyclohexylcarbodiimide, followed by washing the fiber with methanol and water and subsequently drying the fiber with a convection oven of 75° C. while putting the fiber under tension.

Example 5

A regenerated collagen fiber was obtained by applying an insolubilizing treatment to the fiber with a formaldehyde solution, followed by drying the fiber, as in Example 3. The fiber thus prepared was kept dipped for 24 hours at 25° C. in an aqueous solution, the pH value of which was adjusted at 4.5 with hydrochloric acid and sodium hydroxide, containing 15% by weight of L-cystamine dimethyl ester dihydrochloride and 3.5% by weight of 1-ethyl-3-(3'-dimethylaminopropyl)carbodiimide hydrochloride, followed by washing the fiber with water and subsequently drying the fiber with a convection oven of 75° C. while putting the fiber under tension.

Example 6

A regenerated collagen fiber was prepared by method (A) described above.

Then, the resultant fiber was kept dipped for 72 hours at 25° C. in an aqueous solution, the pH value of which was adjusted at 9 with boric acid and sodium hydroxide, containing 2.5% by weight of 2-chloroacetoaldehyde and 12% by weight of sodium sulfate.

The fiber thus prepared was washed with water and, then, kept dipped for 18 hours at 25° C. in an aqueous solution containing 40% by weight of sodium thiosulfate. Then, the resultant fiber was washed again with water, followed by dipping the fiber in an aqueous solution, the pH value of which was adjusted at 3 with sulfuric acid and sodium hydroxide, at 25° C. containing 15% by weight of sodium sulfate for one hour.

Then, a lubricant treatment was applied to the resultant fiber by method (B) described previously, followed by drying the fiber using a convection oven of 75° C. while putting the fiber under tension.

Example 7

A regenerated collagen fiber was prepared by method (A) described above.

Then, the resultant fiber was kept dipped for 72 hours at 25° C. in an aqueous solution, the pH value of which was adjusted at 9 with boric acid and sodium hydroxide, containing 2.5% by weight of 2-chloroacetoaldehyde and 12% by weight of sodium sulfate.

The fiber thus prepared was washed with water and, then, kept dipped for 15 hours at 25° C. in an aqueous solution having a pH value of 12 and containing 6.5% by weight of 70% sodium hydrosulfide. Then, a lubricant treatment was applied to the resultant fiber by method (B) described previously, followed by drying the fiber using a convection oven of 50° C. while putting the fiber under tension.

Example 8

Sodium thiosulfate was added to an aqueous solution, the pH value of which was adjusted at 9 with boric acid and sodium hydroxide, containing 2.5% by weight of 2-chloroacetoaldehyde and 12% by weight of sodium sulfate such that the aqueous solution contained 5.0% by weight of sodium thiosulfate, and the resultant solution was kept stirred for one hour.

Then, a regenerated collagen fiber prepared by method (A) described above was kept dipped for 3 hours at 25° C. in the resultant solution. Further, the resultant fiber was kept dipped for one hour at 25° C. in an aqueous solution, the pH value of which was adjusted at 9 with boric acid and sodium hydroxide, containing 1.0% by weight of formaldehyde and 15% by weight of sodium sulfate. Still further, the resultant fiber was washed again with water, followed by dipping the fiber in an aqueous solution, the pH value of which was adjusted at 3 with sulfuric acid and sodium hydroxide, containing 15% by weight of sodium sulfate for one hour at 25° C.

Finally, a lubricant treatment was applied to the resultant fiber by method (B) described above, followed by drying the fiber using a convection oven of 50° C. while putting the fiber under tension.

Example 9

A regenerated collagen fiber was prepared by method (A) described above. The fiber thus prepared was kept dipped for 2 minutes at 25° C. in an aqueous solution, the pH value of which was adjusted at 9 with boric acid and sodium hydroxide, containing 1.0% by weight of formaldehyde and 15% by weight of sodium sulfate.

Then, the resultant fiber was kept dipped for 3 hours at 25° C. in a reaction solution prepared by adding sodium thiosulfate to an aqueous solution, while stirring for one hour, the pH value of which was adjusted at 9 with boric acid and sodium hydroxide, containing 2.5% by weight of 2-chloroacetoaldehyde and 12% by weight of sodium sulfate such that the reaction solution contained 5.0% by weight of sodium thiosulfate. Further, the resultant fiber was kept dipped for one hour at 250° C. in an aqueous solution, the pH value of which was adjusted at 9 with sulfuric acid and sodium hydroxide, containing 1.0% by weight of formaldehyde and 15% by weight of sodium sulfate.

Then, the resultant fiber was washed with water, followed by keeping the fiber dipped for one hour at 25° C. in an aqueous solution, the pH value of which was adjusted at 3 with sulfric acid and sodium hydroxide, containing 15% by weight of sodium sulfate.

Further, a lubricant treatment was applied to the resultant fiber by method (B) described above, followed by drying the fiber using a convection oven of 50° C. while putting the fiber under tension.

Example 10

Obtained was a regenerated collagen fiber subjected to an insolubilizing treatment with a formaldehyde solution as in Example 9. The fiber was washed with water, followed by keeping the fiber dipped for 24 hours at 25° C. in an aqueous solution, the pH value of which was adjusted at 10.5 with boric acid and sodium hydroxide, containing 5.0% by weight of "DECANOL EX-512", which is a registered trademark of polyglycerol polyglycidyl ether manufactured by Nagase Chemical Industries K.K., 0.05% by weight of 2,4,6-tris(dimethylaminomethyl)phenol and 0.005% by weight of salicylic acid.

The resultant fiber was washed with water, followed by keeping the fiber dipped for 24 hours at 25° C. in an aqueous solution containing 6.5% by weight of a 70% sodium hydrosulfide. Then, a lubricant treatment was applied to the resultant fiber by method (B) described above, followed by drying the fiber using a convection oven of 50° C. while putting the fiber under tension.

Example 11

Obtained was a regenerated collagen fiber subjected to an insolubilizing treatment with a formaldehyde solution as in Example 9. The resultant fiber was washed with water, followed by keeping the fiber dipped for 24 hours in an aqueous solution containing 10% by weight of cystamine dihydrochloride. Then, the resultant fiber was kept dipped for 24 hours at 25° C. in an aqueous solution, the pH value of which was adjusted at 10.5 with boric acid and sodium hydroxide, containing 1.0% by weight of DENACOL EX-512, i.e., polyglycerol polyglycidyl ether referred to previously, 0.1% by weight of 2,4,6-tris (dimethylaminomethyl)phenol, and 0.01% by weight of salicylic acid.

Further, a lubricant treatment was applied to the resultant fiber by method (B) described above, followed by drying the fiber using a convection oven of 50° C. while putting the fiber under tension.

Example 12

Obtained was a regenerated collagen fiber subjected to an insolubilizing treatment with a formaldehyde solution as in Example 9. The resultant fiber was washed with water, followed by keeping the fiber dipped at 25° C. for 24 hours in an aqueous solution, the pH value of which was adjusted at 10.5 with boric acid and sodium hydroxide, containing 5.0% by weight of DENACOL EX-512, i.e., polyglycerol polyglycidyl ether referred to previously, 0.5% by weight of 2,4,6-tris(dimethylaminomethyl)phenol, and 0.05% by weight of salicylic acid. The resultant fiber was washed with water and kept dipped for 24 hours at 25° C. in an aqueous solution containing 1.0% by weight of cystamine dihydrochloride, 0.1% by weight of 2,4,6-tris (dimethylaminomethyl)phenol, and 0.01% by weight of salicylic acid.

Further, a lubricant treatment was applied to the resultant fiber by method (B) described above, followed by drying the fiber using a convection oven of 50° C. while putting the fiber under tension.

Example 13

DENACOL EX-512, i.e., polyglycerol polyglycidyl ether referred to previously, was added to an aqueous solution containing 3.0% by weight of cystamine dihydrochloride over 4 hours while stirring the solution such that DENACOL EX-512 was contained in the resultant solution in an amount of 3.0% by weight.

Then, 0.3% by weight of 2,4,6-tris (dimethylaminomethyl)phenol and 0.03% by weight of salicylic acid were added to the resultant reaction solution. Also, the pH value of the solution was adjusted at 10.5 with boric acid and sodium hydroxide. Then, a regenerated collagen fiber subjected to an insolubilizing treatment with a formaldehyde solution as in Example 9 was kept dipped for 24 hours at 25° C. in the resultant solution.

Further, a lubricant treatment was applied to the resultant fiber by method (B) described above, followed by drying the fiber using a convection oven of 50° C. while putting the fiber under tension.

Example 14

A regenerated collagen fiber was obtained by introducing a mercapto group into the amino group of collagen, followed by drying the modified collagen as in Example 7. The resultant fiber was kept dipped for 24 hours at 25° C. in an aqueous solution, the pH value of which was adjusted at 4.5 with hydrochloric acid and sodium hydroxide, containing 10% by weight of cystamine dihydrochloride and 3.5% by weight of 1-ethyl-3-(3'-dimethylaminopropyl)carbodiimide hydrochloride. Then, the resultant fiber was washed with water and dried using a convection oven of 75° C. while putting the fiber under tension.

Example 15

A regenerated collagen fiber was obtained by introducing a mercapto group into the amino group of collagen, followed by drying the modified collagen as in Example 10. The resultant fiber was kept dipped for 24 hours at 25° C. in methanol containing 3.5% by weight of cystamine dihydrochloride and 3.5% by weight of dicyclohexylcarbodiimide. Then, the resultant fiber was washed with methanol and water, followed by drying the fiber using a convection oven of 75° C. while putting the fiber under tension.

Comparative Example 1

A regenerated collagen fiber was obtained by method (A) described previously. Then, the resultant fiber was kept dipped for 30 minutes at 25° C. in an aqueous solution, the pH value of which was adjusted at 9 with boric acid and sodium hydroxide, containing 1.0% by weight of formaldehyde and 15% by weight of sodium sulfate. Then, a lubricant treatment was applied by method (B) described above, followed by drying the fiber using a uniform air dryer of 75° C. while putting the fiber under tension.

Comparative Example 2

Obtained was a regenerated collagen fiber subjected to an insolubilizing treatment with a formaldehyde solution as in Example 9. The resultant fiber was washed with water, followed by keeping the fiber dipped at 25° C. for 24 hours in an aqueous solution, the pH value of which was adjusted at 10.5 with boric acid and sodium hydroxide, containing 5.0% by weight of Denacol EX-512, i.e., polyglycerol polyglycidyl ether referred to previously, 0.5% by weight of 2,4,6-tris(dimethylaminomethyl)phenol, and 0.05% by weight of salicylic acid. Then, a lubricant treatment was applied by method (B) described previously, followed by drying the fiber using a convection oven of 50° C. while putting the fiber under tension.

Comparative Example 3

Obtained was a regenerated collagen fiber subjected to an insolubilizing treatment with a formaldehyde solution, followed by drying, as in Example 3. The fiber thus obtained was kept dipped for 24 hours at 25° C. in an aqueous solution, the pH value of which was adjusted at 4.5 with hydrochloric acid and sodium hydroxide, containing 1% by weight of cystamine dihydrochloride and 0.3% by weight of 1-ethyl-3-(3'-dimethylaminopropyl)carbodiimide hydrochloride. Then, the resultant fiber was washed with water, followed by drying the fiber using a convection oven of 75° C. while putting the fiber under tension.

(Test Methods)

The regenerated collagen fiber obtained in each of the Examples of the present invention and Comparative Examples described above was tested for physical properties by the methods described below:

Fineness: The fineness was measured under an atmosphere having a temperature of 20±2° C. and a relative humidity of 65±2% using "DENIER-COMPUTER DC-77A", which is a registered trade mark of an Autovibro type fineness measuring apparatus manufactured by Search K.K.

Water Absorption: For determining the water absorption of the fiber, the fiber is kept dipped for 20 minutes in a distilled water having a temperature of 27±1° C., followed by wiping off the water attached to the fiber surface. Then, the fiber is dried with a convection oven of 105° C. To be more specific, the water absorption (%) was determined by a formula given below:

$$\text{Water absorption } (\%)=\{(Ww-Wd)/Wd\}\times 100$$

where Ww denotes the weight (g) of the fiber which was kept dipped for 20 minutes in a distilled water having a temperature of 27±1° C., followed by wiping off the water attached to the fiber surface; and Wd represents the weight (g) of the fiber after drying with a uniform air dryer of 105° C.

Sulfur Content: The fiber was completely combusted by using a sample combustion apparatus QF-02 type manufactured by Mitsubishi Chemical Co., Ltd. The combustion gas was absorbed by an aqueous solution containing 0.3% of hydrogen peroxide. Then, the sulfate ion concentration of the aqueous solution was measured by using an ion chromatography IC-7000 SERIES II manufactured by YOKOGAWA K.K. so as to determine the sulfur content. Further, the amount of sulfur in the form of mercapto group or disulfide linkage was calculated by A=B−C, where A denotes the amount of sulfur in the form of mercapto group or disulfide linkage; B denotes the measured value of the fiber to which mercapto group or disulfide group are introduced; and C represents the measured value of the fiber to which any of mercapto group and disulfide linkage is not introduced. The measured value of the fiber to which mercapto group and/or disulfide linkage are not introduced is directed to methionine residue.

Permanent Wave Treating Test: For evaluating the permanent wave treating effect, 300 to 350 fibers were bundled and cut into a length of 20 cm. On the other hand, an aqueous solution containing 6.5% of thioglycolic acid monoethanol amine, whose pH value was adjusted at 9.2 to 9.6 with monoethanol amine, was prepared as a first solution used for the permanent wave treatment. Also prepared was an aqueous solution containing 5% of sodium bromate as a second solution used for the permanent wave treatment. The bundled fibers prepared first was wound about a No. 5 rod and was kept dipped in the first solution for 15 minutes at 40° C., followed by keeping the bundled fibers dipped in the second solution for 15 minutes at 40° C. After the dipping treatment, the fibers were released from the rod and washed with water under a free state so as to functionally evaluate the waving state within the water. Further, water attached to the fiber surface was removed, followed by measuring the length of the fibers under a hung state. Where the fiber is kept waved after the permanent wave treatment, the fiber is made shorter than 20 cm. If the waving is not retained after the permanent wave treatment, the fiber length is brought back to 20 cm.

Evaluation Standard

The permanent wave treatment was evaluated in terms of the observation of the treated fiber in water and the fiber length when the fiber was hung.

The result of observation of the treated fiber within water is indicated in Table 1 by the marks given below:

TABLE 1

(Observation within water . . . Functional Evaluation)

| Marks | Evaluation |
|---|---|
| ◎ | excellent waving |
| ○ | good waving |
| A | fair waving |
| X | not waved |

The fiber length was measured immediately after the fiber was hung. The evaluation of the fiber length is as shown in Table 2 below:

TABLE 2

| Fiber Length Immediately after Hanging | Evaluation |
|---|---|
| 17 cm or less | Excellent |
| more than 17 cm and 18 cm or less | Good |
| more than 18 cm and 19 cm or less | Fair |
| more than 19 cm and 20 cm or less | Poor |

The results of evaluation are shown in Table 3 in respect of Examples of the present invention, Comparative Examples and the human hair.

TABLE 3

| | | | Sulfur Content (wt %) | | Permanent Wave Effect | |
|---|---|---|---|---|---|---|
| Sample | Fineness (d) | Absorption (%) | Divalent Sulfur | Sulfur in —SH and —SS— form * | Observation in water | Fiber length when hung (cm) |
| Example 1 | 48 | 128 | 2.2 | 2.0 | ○ | 18 |
| Example 2 | 49 | 120 | 2.6 | 2.4 | ○ | 18 |
| Example 3 | 50 | 90 | 2.5 | 2.3 | ◎ | 16 |
| Example 4 | 50 | 105 | 1.5 | 1.3 | ◎ | 17 |
| Example 5 | 51 | 102 | 2.0 | 1.8 | ◎ | 16 |
| Example 6 | 55 | 126 | 0.6 | 0.4 | Δ | 19 |
| Example 7 | 53 | 123 | 1.1 | 0.9 | ○ | 18 |
| Example 8 | 50 | 115 | 1.2 | 1.0 | ○ | 18 |
| Example 9 | 55 | 110 | 1.0 | 0.8 | Δ | 18.5 |
| Example 10 | 51 | 130 | 1.4 | 1.2 | ◎ | 16.5 |
| Example 11 | 53 | 129 | 2.0 | 1.8 | ○ | 17.5 |
| Example 12 | 51 | 134 | 1.3 | 1.1 | Δ | 18 |
| Example 13 | 54 | 133 | 2.5 | 2.3 | ○ | 17.5 |
| Example 14 | 53 | 78 | 4.2 | 4.0 | ◎ | 15 |
| Example 15 | 50 | 108 | 3.1 | 2.9 | ◎ | 16.5 |
| Comparative Example 1 | 50 | 120 | 0.2 | 0 | x | 20 |
| Comparative Example 2 | 52 | 100 | 0.2 | 0 | x | 20 |
| Comparative Example 3 | 52 | 124 | 0.4 | 0.2 | x | 20 |

TABLE 3-continued

| Sample | Fineness (d) | Absorption (%) | Sulfur Content (wt %) Divalent Sulfur | Sulfur in —SH and —SS— form * | Permanent Wave Effect Observation in water | Fiber length when hung (cm) |
|---|---|---|---|---|---|---|
| Human hair | — | — | — | — | ⊙ | 14 |

*The sulfur in —SH and —SS— form was determined by subtracting the sulfur content of methionine residue (0.2% by weight) from the measured value.

TABLE 3

| Sample | Fineness (d) | Absorption (%) | Sulfur Content (wt %) Divalent Sulfur | Sulfur in -SH and -SS- form * | Permanent Wave Effect Observation in water | Fiber length when hung (cm) |
|---|---|---|---|---|---|---|
| Example 14 | 53 | 78 | 4.2 | 4.0 | ⊙ | 15 |
| Example 15 | 50 | 108 | 3.1 | 2.9 | ⊙ | 16.5 |
| Comparative Example 1 | 50 | 120 | 0.2 | 0 | X | 20 |
| Comparative Example 2 | 52 | 100 | 0.2 | 0 | X | 20 |
| Comparative Example 3 | 52 | 124 | 0.4 | 0.2 | X | 20 |
| Human hair | — | — | — | — | ⊙ | 14 |

* The sulfur in -SH and -SS- form was determined by subtracting the sulfur content of methionine residue (0.2% by weight) from the measured value.

As apparent from Table 3, the regenerated collagen fiber having a mercapto group and/or a disulfide linkage exhibits an excellent permanent wave treating effect.

Examples 16 to 24

Some of the fibers obtained in Examples 3 and 6 to 13 were kept dipped at 15° C. for 15 hours in a crosslinking solution of containing 3% by weight of sodium sulfate and 4% by weight of "NEOCHROME R" (registered trademark of a basic chromium sulfate manufactured by Nihon Kagaku Kogyo K.K.) and having a pH value of 3. Then, the resultant fibers were washed with water, followed by drying the fibers using a convection oven of 75° C. while putting the fibers under tension. Since a crosslinking treatment with chromium was applied to the fibers, the water absorption of the fibers was lowered as shown in Table 4 so as to further improve the wet feel of the fibers.

TABLE 4

| | Sample used for Crosslinking with Chromium | Fineness (d) | Water Absorption (%) |
|---|---|---|---|
| Example 16 | Example 3 | 53 | 84 |
| Example 17 | Example 6 | 56 | 76 |
| Example 18 | Example 7 | 58 | 74 |
| Example 19 | Example 8 | 55 | 81 |
| Example 20 | Example 9 | 55 | 78 |
| Example 21 | Example 10 | 58 | 73 |
| Example 22 | Example 11 | 57 | 75 |
| Example 23 | Example 12 | 57 | 78 |
| Example 24 | Example 13 | 54 | 79 |

As described above, the improved regenerated collagen fiber of the present invention has divalent sulfur atoms such as a mercapto group and/or a disulfide linkage. As a result, the crosslinkage between molecules is altered by a redox reaction to allow the fiber to be optionally deformed. In addition, the deformed shape can be retained. Further, since the regenerated collagen fiber of the present invention is formed of a natural protein fiber, the fiber is very close to the human hair in draping, luster and feel and, thus, can be used as an excellent substitute for the human hair, animal hair and catgut.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. Isolated regenerated collagen fiber which are useful as a substitute for human or animal hair which can be subjected to a permanent wave treatment, having mercapto or disulfide groups introduced by chemical modification by diamine or halogenated aldehyde, wherein a sulfur content of said mercapto and disulfide groups falls within a range of between 0.7 and 5.1% by weight based on the collagen.

2. The regenerated collagen fiber according to claim 1, wherein an amount of divalent sulfur falls within a range of between 0.9 and 5.4% by weight based on the collagen.

3. A method of manufacturing isolated regenerated collagen fibers which are useful as a substitute for human or animal hair which can be subjected to a permanent wave treatment, wherein an amino group of collagen is chemically modified to introduce mercapto or disulfide groups into said collagen.

4. The method of manufacturing isolated regenerated collagen fibers according to claim 3, wherein said collagen is treated with an aqueous solution containing at least one compound selected from the group consisting of an aldehyde represented by general formula (III), a thiosulfate and a hydrosulfide, $$X_nRCHO \quad (III)$$

where X represents a halogen atom, R denotes a hydrocarbon radical having at most three carbon atoms, and n is an integer of 1 to 3.

5. The method of manufacturing isolated regenerated collagen fibers according to claim 3, wherein collagen is treated with an epoxy compound and with a sulfur-containing compound so as to introduce a mercapto group or a disulfide group to said collagen.

6. A method of manufacturing isolated regenerated collagen fibers which are useful as a substitute for human or animal hair which can be subjected to a permanent wave treatment, comprising the steps of:

introducing a mercapto or a disulfide group to collagen by chemical modification; and treating the resultant collagen with an aqueous solution of a metal salt.

7. A method of manufacturing isolated regenerated collagen fibers which are useful as a substitute for human or animal hair which can be subjected to a permanent wave treatment, wherein a carboxyl group of collagen is chemically modified to introduce mercapto or disulfide groups into said collagen.

8. The method of manufacturing isolated collagen fibers according to claim 7, wherein collagen is subjected to an amidation reaction in the presence of a diamine and a condensing agent, said diamine being represented by general formula (I):

$$H_2N(CH_2)_nSS(CH_2)_mNH_2 \quad (I)$$

where n and m is an integer of 1 to 4, or general formula (II):

$$H_2NCH(COOR_1)CH_2SSCH_2CH(COOR_2)NH_2 \quad (II)$$

where $R_1$ and $R_2$ denotes an alkyl group having 1 to a carbon atoms or a benzyl group.

9. The method of manufacturing a regenerated collagen fiber according to claim 8, wherein said regenerated collagen fiber is dried and, then, subjected to said amidation reaction.

10. The method of manufacturing isolated regenerated collagen fibers, wherein the method defined in claim 7 or 8 is employed in combination with the method defined in claim 5.

* * * * *